US006311944B1

(12) United States Patent
McKsymick et al.

(10) Patent No.: US 6,311,944 B1
(45) Date of Patent: Nov. 6, 2001

(54) PORTABLE COMPUTER FOLDABLE SUPPORTING STAND

(76) Inventors: William E. McKsymick, 5208 Stagetrail Dr., Arlington, TX (US) 76017; Mark J. McKsymic, 16506 Centerpointe Dr., Grover, MO (US) 63040

( * ) Notice: Subject to any disclaimer, the term of this patent is extended or adjusted under 35 U.S.C. 154(b) by 0 days.

(21) Appl. No.: 09/345,155

(22) Filed: Jun. 29, 1999

Related U.S. Application Data

(63) Continuation-in-part of application No. 09/111,223, filed on Jul. 7, 1998, now abandoned, which is a continuation-in-part of application No. 08/846,568, filed on Apr. 30, 1997, now abandoned.

(51) Int. Cl.[7] ..... A47B 97/04

(52) U.S. Cl. ..... 248/461; 248/150; 248/170; 108/36; 108/69; 108/132

(58) Field of Search ..... 248/461, 439, 248/460, 462, 463, 464, 452, 166, 170, 118, 118.1, 676, 918, 150; 108/127, 65, 69, 90, 116, 147.19, 147.2, 147.21, 132, 36, 34; 190/11

(56) References Cited

U.S. PATENT DOCUMENTS

| | | | | |
|---|---|---|---|---|
| D. 342,121 | * | 12/1993 | Lim | D23/286 |
| 1,520,589 | * | 12/1924 | Matkovic | 248/439 |
| 2,542,394 | * | 2/1951 | Cohen et al. | 108/36 |
| 2,751,271 | * | 6/1956 | Dessertenne et al. | 312/231 |
| 2,760,837 | * | 8/1956 | Wade | 108/36 |
| 3,246,611 | * | 4/1966 | Benlian | 108/1 |
| 3,298,478 | * | 1/1967 | Soprani | 190/11 |
| 3,315,621 | * | 4/1967 | Szymber | 108/34 |
| 4,034,518 | * | 7/1977 | Trecker | 5/114 |
| 4,191,111 | * | 3/1980 | Emmert | 108/132 |
| 4,412,604 | * | 11/1983 | Bell et al. | 190/1 |
| 4,856,627 | * | 8/1989 | Polatov | 190/11 |

* cited by examiner

*Primary Examiner*—Anita King
(74) *Attorney, Agent, or Firm*—John D. Gugliotta; P. Jeff Martin

(57) ABSTRACT

A portable computer folding support stand is provided having a table top forming a concave leg retaining cavity on the underside. A pair of parallely arranged, pivotally affixed leg assemblies are attached to the lower surface, and each leg assembly folds down within the leg retaining cavity.

7 Claims, 7 Drawing Sheets

PORTABLE COMPUTER FOLDABLE SUPPORTING STAND

RELATED APPLICATIONS

The present invention is a Continuation in Part of Ser. No. 09/111,223, filed on Jul. 7, 1998, which is a CIP application in Ser. No. 08/846,568, filed on Apr. 30, 1997, and both now abandoned.

FIELD OF THE INVENTION

This invention relates to a portable table for holding various objects. More particularly, the invention relates to a compact, portable computer stand for supporting laptop computers and associated components.

BACKGROUND OF THE INVENTION

In recent years the laptop portable personal computer, or simply "laptop" to which it is generally referred, has become an increasingly popular tool used by executives, salespersons, engineers, students, accountants, teachers, homemakers, lawyers and other business and professional persons. The laptop is very compact and was designed to rest in the user's lap so that the user has a "built-in" place for supporting the laptop when the user is seated. While this "built-in" supporting spot is convenient, it has many drawbacks. For one, the user's legs must be held still in order to keep the laptop from moving around. This is uncomfortable and can be a tiring exercise. Additionally, the user must have good balance to maintain the laptop in a position which can be particularly difficult when the user is using the laptop in conjunction with reading notes, books or other materials, as is often the case.

Other stands have been disclosed such as the one described by U.S. Pat. No. 5,054,736 which provides a laptop reading and writing stand, yet it suffers from the same problems connected with laptop computers because it rests on the lap of the user. Additionally, stands for computers are disclosed in U.S. Pat. Nos. 5,100,098 and 5,357,873; however, since neither of these patents specifically deal with laptops neither solves the above-described problems associated with laptop computers.

Workstations have been designed for laptops as shown in U.S. Pat. Nos. 4,830,328, 5,379,893, 5,445,266 and 5,470,041 which generally disclose workstations for supporting a laptop on a permanent desktop or table located in a business or residential environment. U.S. Pat. No. 4,830,328 also discloses the attachment of a pipe flange or straight coupling to the first plate to allow mounting to a tripod.

The foregoing patents demonstrate that there is a need for a computer stand that is compact, stable, lightweight, foldable, and has adjustable height.

BRIEF SUMMARY OF THE INVENTION

According to one embodiment of the present invention, a support for a portable laptop computer is provided which provides a table top having a generally planar upper surface for supporting a conventional portable computer in a horizontal position for facilitating use of the portable computer. The table top has an inner surface and a side lip circumscribing the upper surface and extending perpendicularly downward, thereby forming within a concave leg retaining cavity. A pair of parallely arranged, pivotally affixed leg assemblies attach pivotally to said lower surface such that the leg assemblies can be folded within said concave leg retaining cavity for storage of said support stand.

BRIEF DESCRIPTION OF THE DRAWING

The advantages and features of the present invention will become better understood with reference to the following more detailed description and claims taken in conjunction with the accompanying drawings, in which like elements are identified with like symbols, and in which:

DETAILED DESCRIPTION OF THE PREFERRED EMBODIMENT

Figure 1:
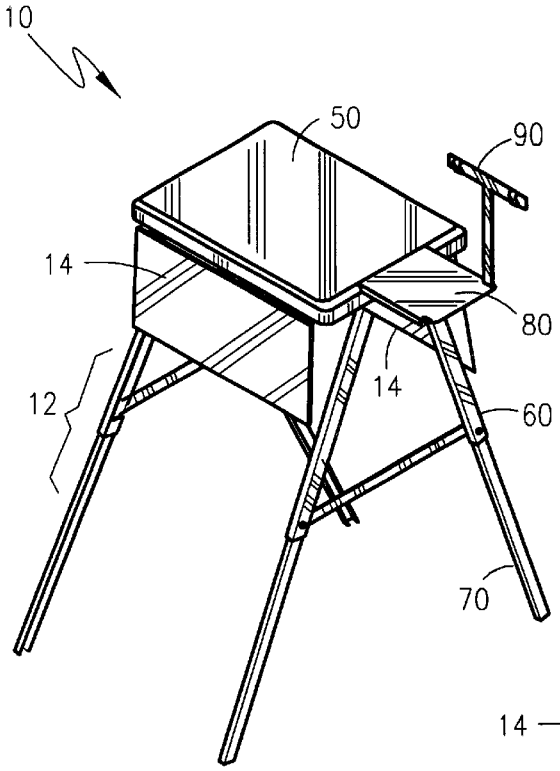
FIG. 1 is an upper perspective view of a portable computer foldable supporting stand according to the preferred embodiment of the present invention.

The Figures generally illustrate the preferred embodiment of the invention. A portable computer folding support stand, generally noted as 10, is shown comprised of a table top 50 having a generally planar upper surface 51 for supporting a conventional portable computer 20 in a horizontal position for facilitating use of the portable computer. Circumscribing the upper surface 51 and extending perpendicularly downward is a side lip 52, thereby forming within a concave leg retaining cavity 53, whose function will be better described below. Forming the inner surface of the cavity 53 is a generally planar lower surface 54, upon which is attached a pair of parallely arranged, pivotally affixed leg assemblies 12. Pivotally affixed along the lower edge of the side lip 52, and at opposite sides of the table top 10, are a pair of closing and supporting flaps 14. Each flap 14 is pivotally affixed at its upper edge along the respective side lip 52, and is dimensioned to protrude exactly half way across the concave retaining cavity 53 when pivoted toward the lower surface 54. In this manner, two such flaps 14 opposed can form a closable lower surface, thereby securing a storage volume within the concave lower retaining cavity 53 into which the pivotally affixed leg assemblies 12 can be retreated for storage. In this manner, when not in use the present invention can be folded into a compact, easily transportable volume.

Each leg assembly 12 is formed of a upper leg 60 and a pair of lower legs 70. Each upper leg 60 comprises a first upper channel 61*a* and a second upper channel 61*b*. The design of each upper channel 61*a*, 61*b* are similar in construction, with the second upper channel 61*b* being affixed to and at an acute angle with the first upper channel 61*a* by means of an upper cross member 62 and a lower cross member 63. In such a configuration, the upper leg 60 forms a generally "A" shape, providing both vertical strength and lateral rigidity that are necessary for support of the table top 50 when in use. Each upper channel 61*a*, 61*b*, includes a closing flap connection means 62, herein shown as a receiving clip, the operation of which will be described more fully below, and forms an identical sliding channel 64 supported completely along its length on three sides. This channel receives a lower leg 70 in a telescoping manner. The lower leg 70 is retained within the channel 64 by means of a retaining cross member 65 spanning the channel 64 at any point along its length. A retaining pin orifice 66 is formed by the channel 64, and is used to retain the lower leg 70 from completely exiting the channel 64 when the lower leg 70 is telescoped outward in a manner that will be described below.

The lower leg 70 comprises a linear extension of the upper channel 64, and as such is utilized to provide additional vertical extension of the leg assemblies 12 when the table 10 is being used. Formed as a linearly elongated member, each lower leg 70 forms a protruding retaining pin 72 at one end engaging with retaining pin orifice 66 at the inside of the upper leg channel 64. In this manner, the lower leg 70 can be telescoped outward and locked into place in a linearly extended condition. Alternately, the lower leg 70 can be retracted within the upper leg channel 64 for folding and storage purposes.

Figure 2:
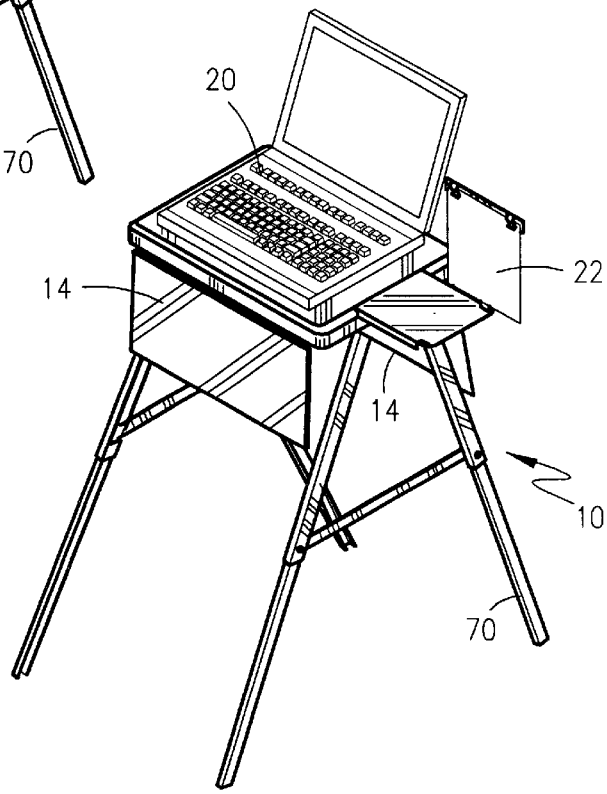
FIG. 2 is a lower perspective view thereof, shown in an open condition.
Figure 3:
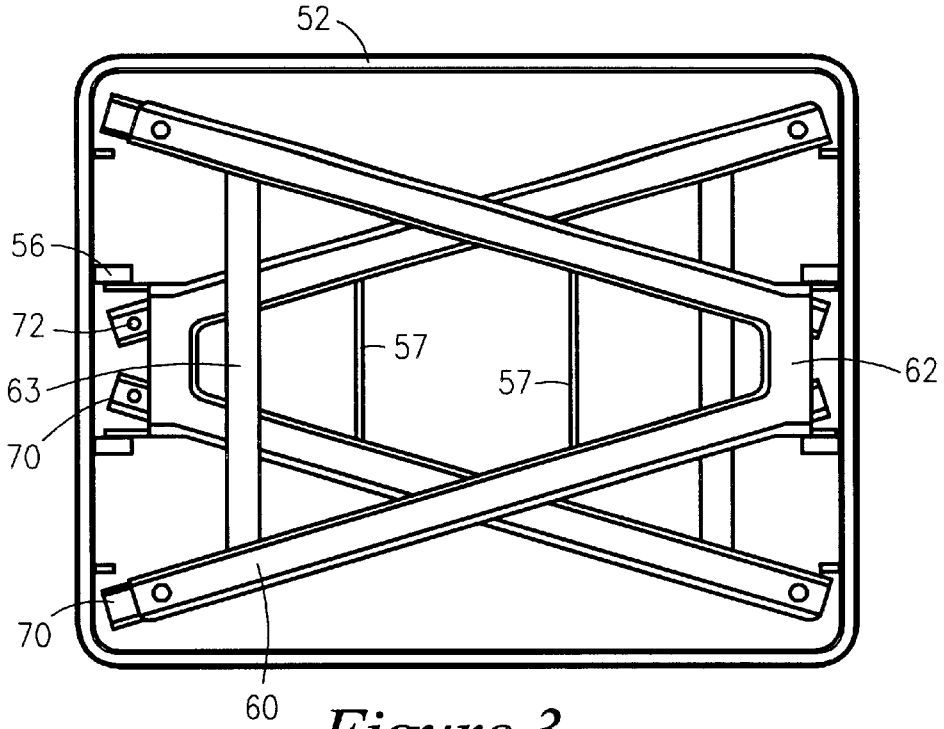
FIG. 3 is a lower perspective view thereof, shown in a closed condition.
Figure 4:
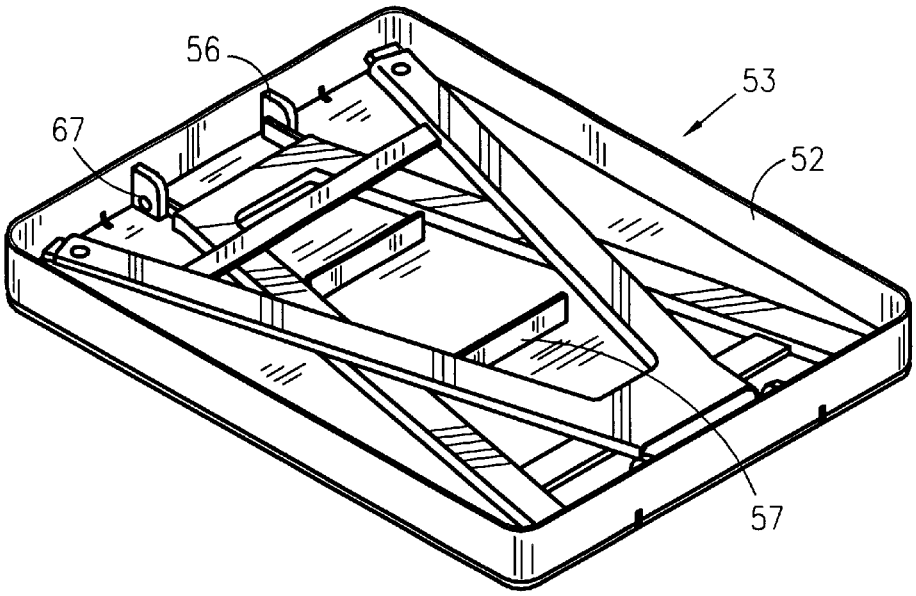
FIG. 4 is a top plan view thereof.
Figure 5A:
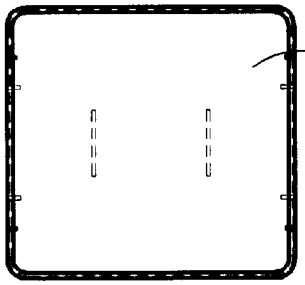
FIG. 5*a* through FIG. 5*e* are views of the table top shown in detail in a top plan, front isometric, bottom isometric, side elevational, and front elevational views, respectively.
Figure 5B:
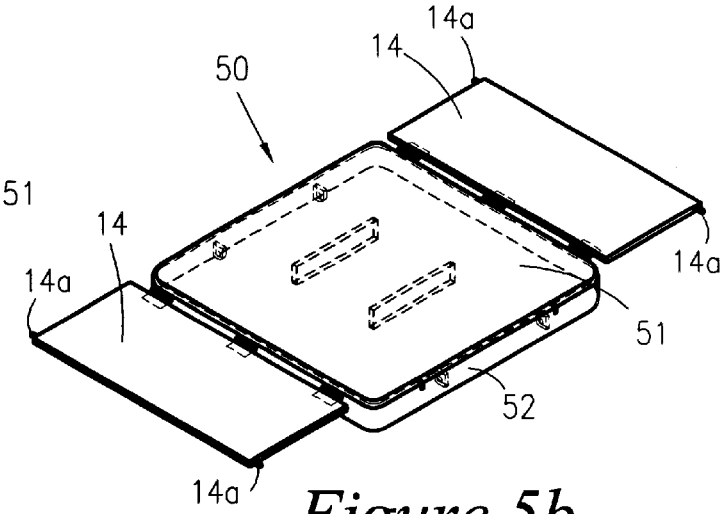
Figure 5C:
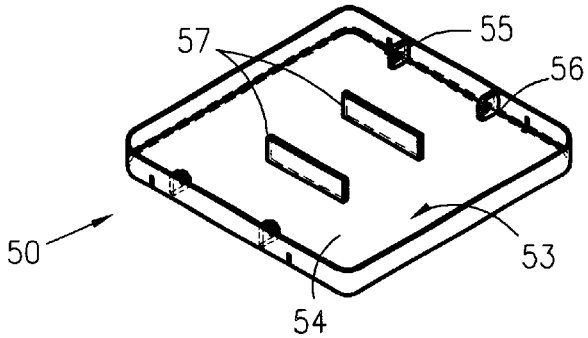
Figure 5D:
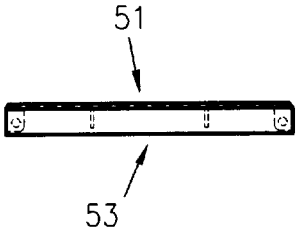
Figure 5E:
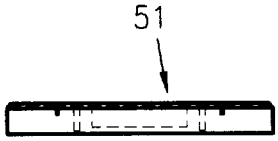
Figure 6A:
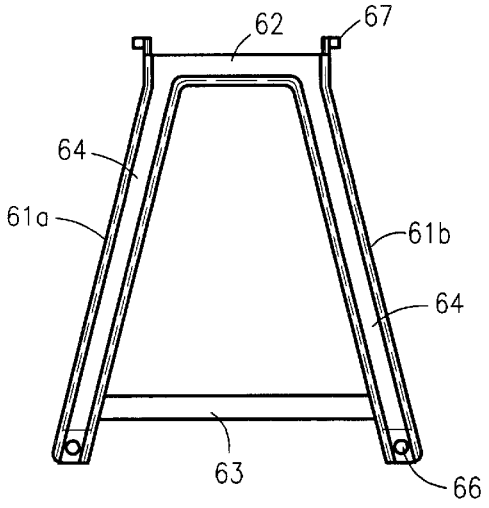
FIG. 6*a* through FIG. 6*e* are views of one upper leg shown in detail in a front elevational; front isometric, rear isometric, bottom elevational and side elevational views, respectively.
Figure 6B:
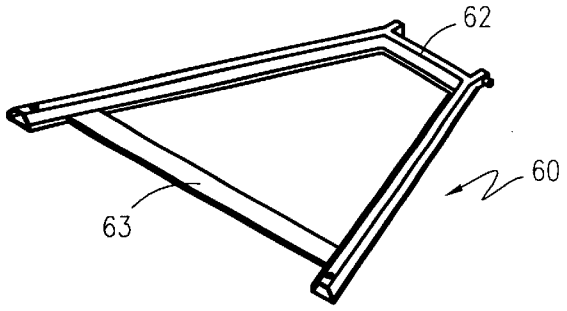
Figure 6C:
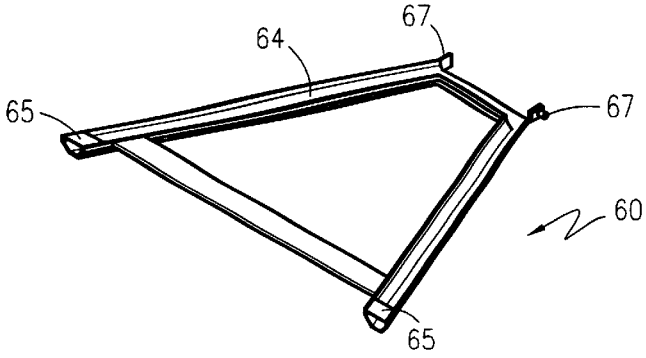
Figure 6D:
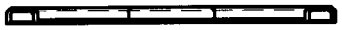
Figure 6E:
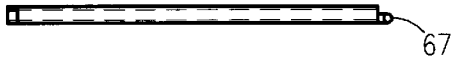
Figure 7A:
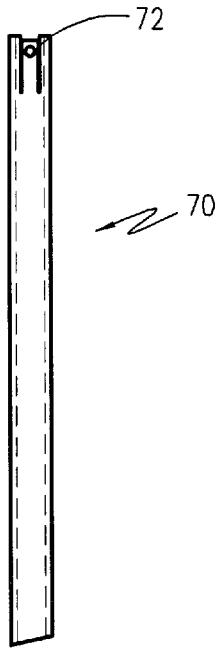
FIG. 7*a* through FIG. 7*e* are views of the lower legs shown in detail in a bottom plan, front isometric, bottom isometric, side elevational, and front elevational views, respectively.
Figure 7B:
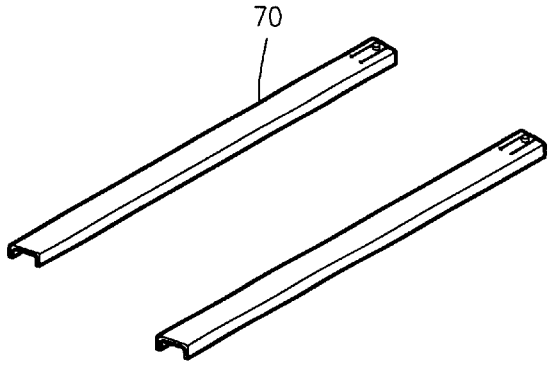
Figure 7C:
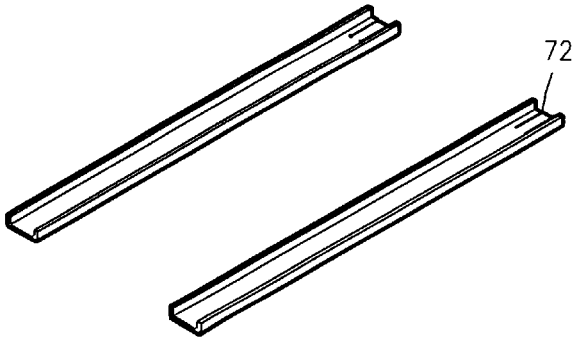
Figure 7D:
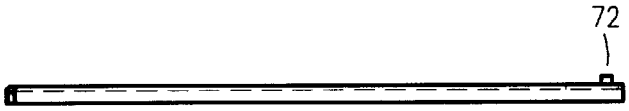
Figure 7E:
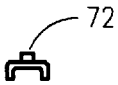
Figure 8A:
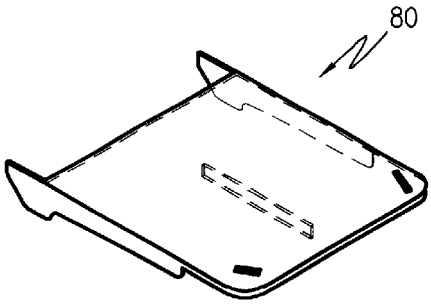
FIGS. 8*a* through 8*e* are views of the mouse pad shown in detail in a top isometric, bottom isometric, top plan, side elevational, and front elevational views, respectively.
Figure 8B:
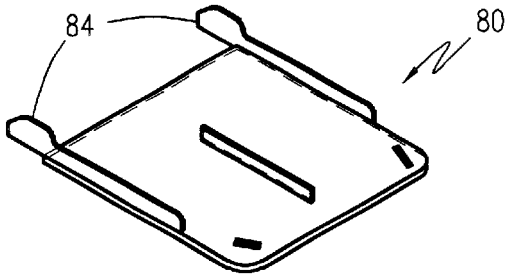
Figure 8C:
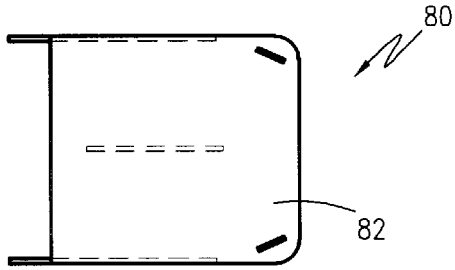
Figure 8D:
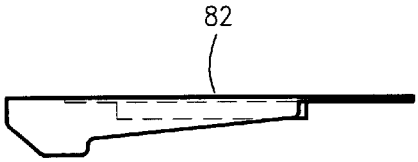
Figure 8E:
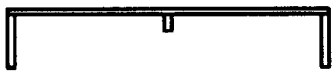
Figure 9A:
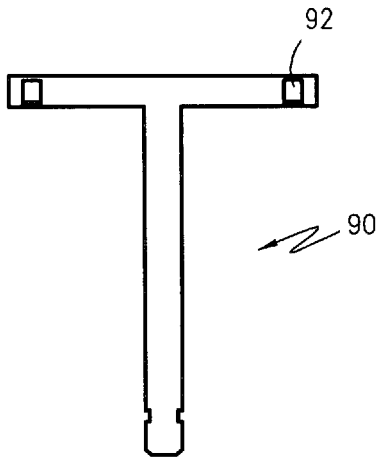
FIGS. 9*a* through 9*d* are views of the paper holder shown in detail in a top plan, front isometric, side elevational, and front elevational views, respectively.
Figure 9B:
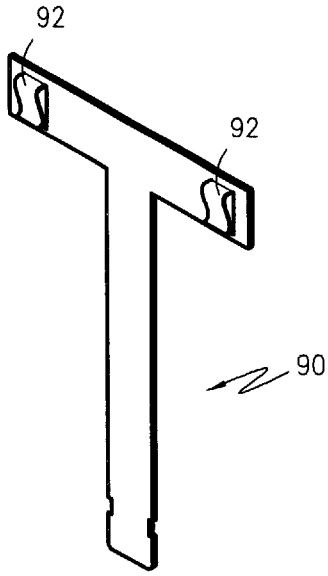
Figure 9C:
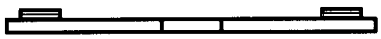
Figure 9D:
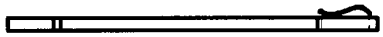

Folding and storage can best be described in conjunction with FIG. 1 through FIG. 3. Each upper leg 60 includes a pair of opposed, linearly aligned upper leg pivoting pins 67. Each such pivoting pin 67 is inserted into a pivoting pin receiving orifice 55 formed within a leg mounting tab 56 on the bottom of the table top 50. In this manner, each leg 12 can be retracted, with the lower legs 70 retracting into the upper leg assembly 60, and the upper legs 60 thereafter pivoted inward to fold under and into the table top 50. In this manner, the entire support stand 10 can be collapsed into a narrow profile that is small enough to be transported by and stored within a conventional carrying case of the type commonly in use for storing and transporting conventional laptop computers.

In order to provide added structural rigidity, as well as function as a guide for folding and storing the leg assemblies 12, a pair of spacer guides 57 are formed extending outward from the bottom surface 53 of the table top 50. These protruding tabs function to guide and support the leg assemblies 12 when folded.

While the preferred embodiments of the invention have been shown, illustrated, and described, it will be apparent to those skilled in this field that various modifications may be made in these embodiments without departing from the spirit of the present invention. Envisioned examples are numerous. By way of example, and not by limitations, it is envisioned that various attachments for the portable computer support stand 10 can be provided, in the form of a mouse pad 80, shown in FIGS. 8*a*–8*e*, a paper holder 90, shown in FIGS. 9*a*–9*d*, or the like. The mouse pad 80 is formed of a generally planar upper surface 82 formed of a tactilely resilient material for facilitating the usage of a computer mouse input device. Although many portable computers have separate, attached mouse input devices, such an attachment would be useful. However, since many newer portable computers have integral pointing devices, such a mouse pad 80 may not be necessary or desired. Therefore, it is envisioned that such a mouse pad 80 have a retaining means 84, shown herein as a pair of retaining clips for attachment to the side lip 52 of the table top 50. Although such a mouse pad 80 may be unnecessary for use with some portable computers, the attachment of the paper holder 90, shown as a vertically elongated "T" shaped retaining bar supporting a pair of upper paper retaining clips 92 can be optionally added by affixing to the mouse pad 80, thereby allowing paper copy 22 to be retained in a conveniently readable position aside a portable computer 20.

What is claimed is:

1. A portable computer folding support stand comprising:

a table top having a generally planar upper surface for supporting a conventional portable computer in a horizontal position for facilitating use of the portable computer, said table top having an inner surface and a side lip circumscribing the upper surface and extending perpendicularly downward, thereby forming within a concave leg retaining cavity;

a pair of closing and supporting flaps, each said flap pivotally affixed along a lower edge of the side lip and at opposite sides of the table top, each flap having an upper edge and wherein the flap is pivotally affixed at said upper edge along the respective side lip and is dimensioned to protrude exactly half way across the concave retaining cavity such that when pivoted toward a lower surface, two such flaps opposed can form a closable lower surface enclosing said concave retaining cavity, and a pair of parallely arranged, pivotally affixed leg assemblies attached to said lower surface, wherein each said leg assembly includes a closing flap connection means; and each said closing and supporting flap includes a protruding connection pin that affixes to and is retained by the flap connection means; and wherein said leg assembly and said closing and supporting flap help form a rigid support structure for said table top.

2. The portable computer folding support stand of claim 1, wherein each said leg assembly is formed of a upper leg and a pair of lower legs, said lower legs being retractable within said upper leg.

3. The portable computer folding support stand of claim 2, wherein each upper leg comprises a first upper channel and a second upper channel, said second upper channel being affixed to and at an acute angle with the first upper channel by attachment to an upper cross member and a lower cross member.

4. The portable computer folding support stand of claim 3, wherein each said upper channel forms a sliding channel supported completely along a length of said sliding channel on three sides such that said sliding channel receives one of said pair of lower legs in a telescoping manner, and further that said lower leg is retained within said sliding channel by attachment to a retaining cross member spanning said sliding channel at any point along a length of said sliding channel.

5. The portable computer folding support stand of claim 4, wherein said lower legs comprise a linear extension of the upper channels formed as a linearly elongated member, and further wherein each lower leg forms a protruding retaining pin at one end engaging with a retaining pin orifice formed at the inside of the upper leg channels, and whereby the retaining pin orifice is formed by said channel and is used to retain the lower leg from completely exiting the channel when the lower leg is telescoped outward.

6. The portable computer folding support stand of claim 3, wherein each upper leg includes a pair of opposed, linearly aligned upper leg pivoting pins, each such pivoting pin being inserted into a pivoting pin receiving orifice formed within a leg mounting tab on the bottom of said table top such that the entire support stand can be collapsed into a narrow profile that is small enough to be transported by and stored within a conventional carrying case of the type commonly in use for storing and transporting conventional laptop computers.

7. The portable computer folding support stand of claim 6, further comprising a pair of spacer guides formed extending outward from the bottom surface of the table top.

* * * * *